US006370906B1

(12) United States Patent
Kuo

(10) Patent No.: US 6,370,906 B1
(45) Date of Patent: Apr. 16, 2002

(54) WIND INLET AND OUTLET SYSTEM FOR AN AIR CONDITIONER

(76) Inventor: Chin-Sheng Kuo, Chin-Sheng KUO P.O. Box 90, Tainan City (TW)

( * ) Notice: Subject to any disclaimer, the term of this patent is extended or adjusted under 35 U.S.C. 154(b) by 0 days.

(21) Appl. No.: 09/559,458

(22) Filed: Apr. 28, 2000

(30) Foreign Application Priority Data

May 10, 1999 (TW) ..... 88207388

(51) Int. Cl.[7] ..... F25D 17/06

(52) U.S. Cl. ..... 62/412; 62/426; 62/419; 62/314; 454/245; 454/246; 454/247; 454/248

(58) Field of Search ..... 62/426, 419, 314, 62/412; 454/245, 246, 247, 248

(56) References Cited

U.S. PATENT DOCUMENTS 4,512,241 A * 4/1985 Morris et al. ..... 98/32
4,917,862 A * 4/1990 Kraw et al. ..... 422/4
5,076,152 A * 12/1991 Muller et al. ..... 454/245
5,325,681 A * 7/1994 Ellis et al. ..... 62/314

* cited by examiner

*Primary Examiner*—William Doerrler
*Assistant Examiner*—Mark Shulman

(57) ABSTRACT

A wind inlet and outlet case for a blower of an air conditioning system is connected to an inner machine, including a body and a faceplate. The body is separated into a wind inlet room and a wind outlet room with a lengthwise vertical wall, and the wind inlet room and the wind outlet room are respectively connected with the inner machine with a separate guide pipe. The faceplate is combined with the body, having a wind outlet provided with a movable leaf unit to change direction of wind blown out, and with a wind inlet provided with a filter. Thus plural sets of the wind inlet and outlet cases may be connected to the inner machine, wind blown out and wind sucked back are guided separately by guide pipes to keep good quality of air, lowering cost, and facilitating maintenance and repair.

4 Claims, 5 Drawing Sheets

WIND INLET AND OUTLET SYSTEM FOR AN AIR CONDITIONER

BACKGROUND OF THE INVENTION

This invention relates to a wind inlet and outlet case for a blower of an air conditioning system, particularly to one consisting of a body and a face plate, connected to an inner machine to have plural wind inlet and outlet cases convenient to install with low cost, maintaining good air quality.

At present most conventional central air conditioning systems, as shown in FIG. 1, includes an outer machine A1 as main power source, one or more inner machines A2 installed in one or more rooms and connected to the outer machine A1. The inner machine A2 is positioned in a preset proper location (for example, in a middle layer between a ceiling plate and a floor plate, to supply cool or hot air. One or more wind outlets A3 are connected with the inner machine with guide pipes, having a faceplate flush with the ceiling. Further one or more wind inlets A4 are also provided on a surface of the ceiling, having respectively a faceplate and a filter to suck out waste air in the room.

However, the conventional central air conditioning systems generally have the following disadvantages.

1. As the wind inlet A4 is not connected with an exhaust pipe to guide out waste air, hot waste air staying in the intermediate layer between the ceiling and the floor plate may enter the room mixed with cool air, affecting cooling effect.
2. Although the wind inlet A4 has a filter, and the sucking opening of the inner machine does not have a filter, so when the inner machine sucks in cool air from the outer machine, those waste air in the intermediate layer may mix with the clean cool air into the room floating in the cool air and then exhausted out of the wind outlet A3, worsening air quality.
3. If the wind inlet A4 is to be connected with a guide pipe to achieve exhausting effect, the wind inlet A4 has to be connected with an exhausting pipe, increasing cost, not economical.
4. The conventional blower buried in the ceiling has to be provided with plural wind inlets and wind outlets in the surface of the ceiling, forming not good outer appearance.

So some makers offer a kind of conventional inner machines 2, as shown in FIG. 2, including also an outer machine 1 and an inner machine 2 provided with a wind inlet 20 and a wind outlet 21 formed integral with the inner machine 2 to have good appearance. Though this inner machine with the wind inlet 20 and the wind outlet 21 integral is convenient, more than two inner machines have to be installed in a comparatively large room, or its cooling effect may not enough, resulting in high cost. Besides, the wind inlet and the wind-outlet plate are too close to the operating portion of the inner machine 2, producing unpleasant noise of the operation. In addition, the inner machine has a heavy weight, not convenient to carry, install or repair.

SUMMARY OF THE INVENTION

The wind inlet and outlet case for a blower of an air conditioning system in the present invention includes a body and a faceplate combined together and connected to an inner machine.

The feature of the invention is the body having a wind outlet room and a wind inlet room separated with a lengthwise vertical wall. The wind outlet room and the wind inlet room are separately connected with the inner machine with separate guide pipes, and the faceplate has a wind inlet and a wind outlet respectively facing the wind inlet room and the wind outlet room.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
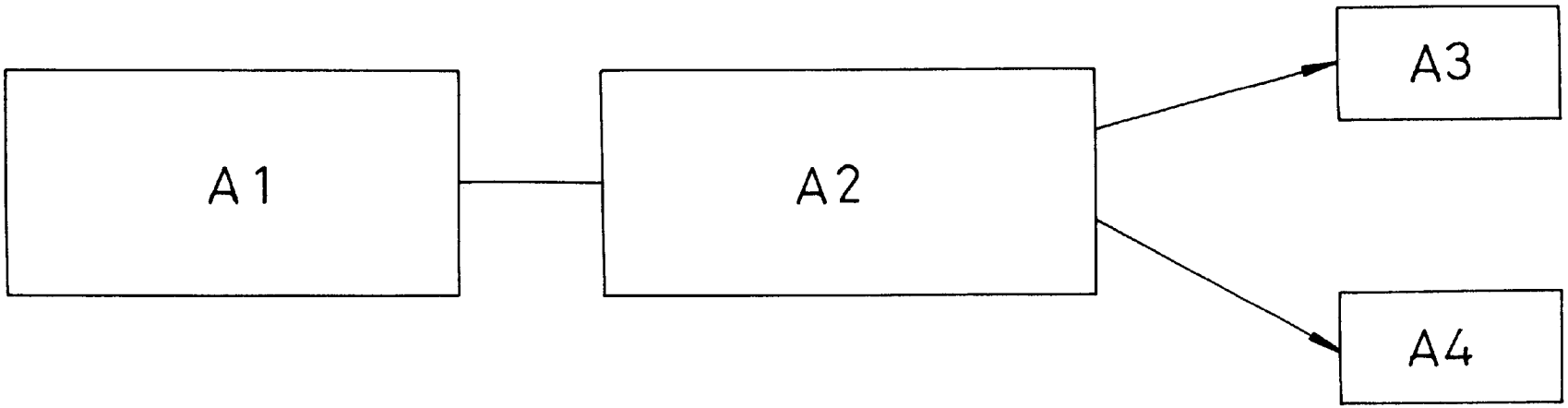
FIG. 1 (PRIOR ART)
FIG. 1 is a block diagram of a conventional central air conditioning system.
Figure 2:
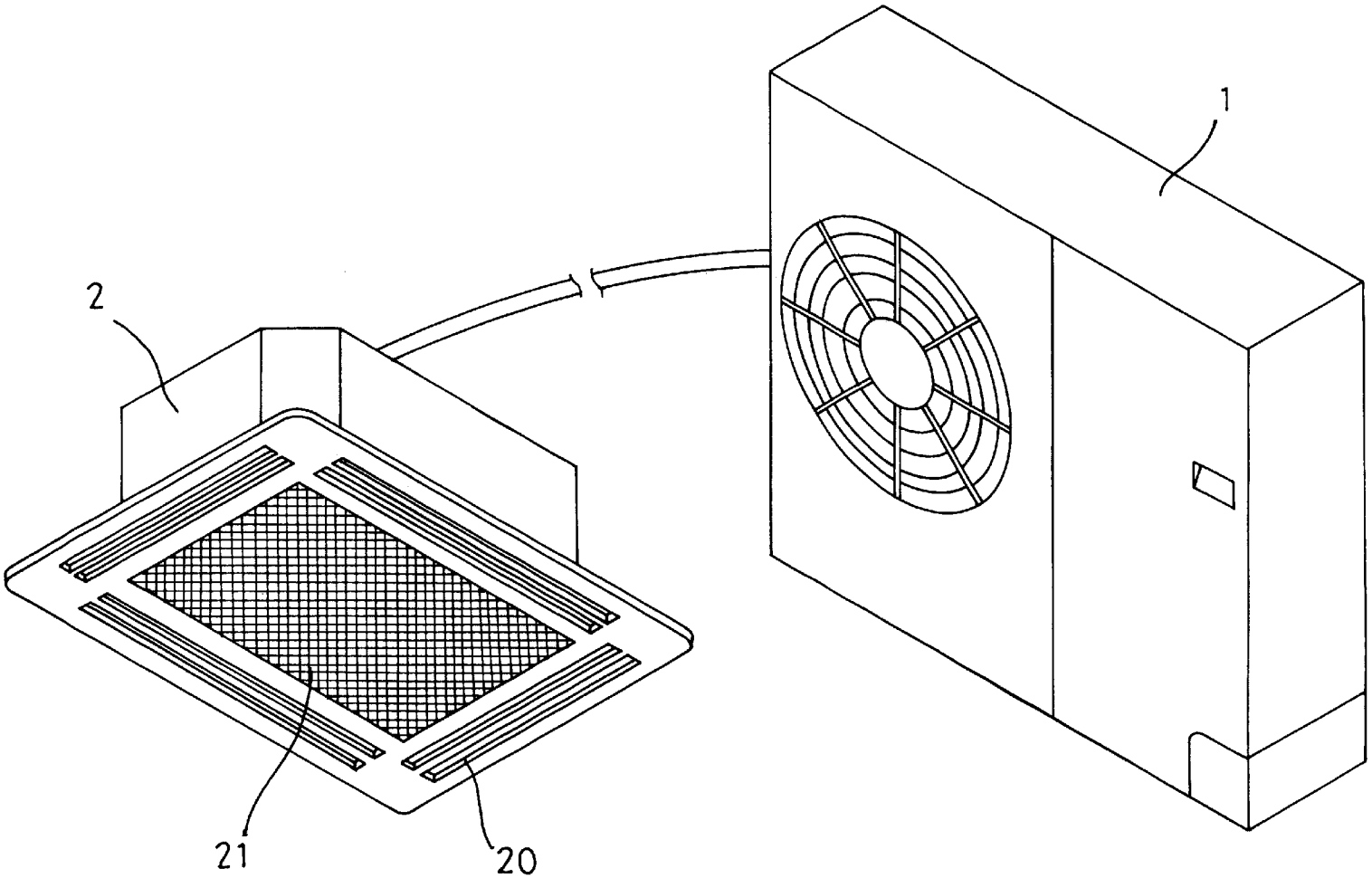
FIG. 2 (PRIOR ART)
FIG. 2 is a perspective view of a conventional fitting-in inner machine.

A preferred embodiment of a wind inlet and outlet case for a wind blower of an air conditioning system in the present invention includes an outer machine and an inner machine as a conventional one, and a wind inlet and outlet case 3 connected to the inner machine. The wind inlet and outlet case 3 has a body 30 and a face plate 31 combined together, and the body 30 has a lengthwise separating wall 300 in the intermediate portion, a wind outlet room 301 and the wind inlet room 302 separated by the separating wall. Further, a wind guide pipe 32 is connected to an outer wall of the wind outlet room 301 and two wind guide pipes 302 connected to an rear wall of the wind inlet room 302, and those wind guide pipes 32 are connected to the inner machine. The inner walls of the wind outlet room 301 are attached with a layer of temperature preserving material 33 to preserve the temperature in the wind outlet room 301 and prevent water drops from forming when cool wind contact with hot air. Further, the wind inlet and outlet case 3 has a lengthwise projecting connect edge 34 respectively extending from a lower end of a front and a rear side, and plural bolt holes bored in each connect edge 34 to screw with the faceplate 31 positioned on the surface B of the ceiling in the flush condition. Then the body 30 and the faceplate 31 are combined together, and the faceplate 31 has a wind outlet 310 and a wind inlet 311 respectively facing toward the wind outlet room 301 and the wind inlet room 302. The wind outlet 310 has a vertical leaf unit 312, and the wind inlet 311 has a filter 313. The face plate 31 has four holes 314 at four corners, and a lengthwise projecting bar 315 formed between the wind outlet 310 and the wind inlet 311 to combine with the separating wall 300 of the body 30.

Figure 3:
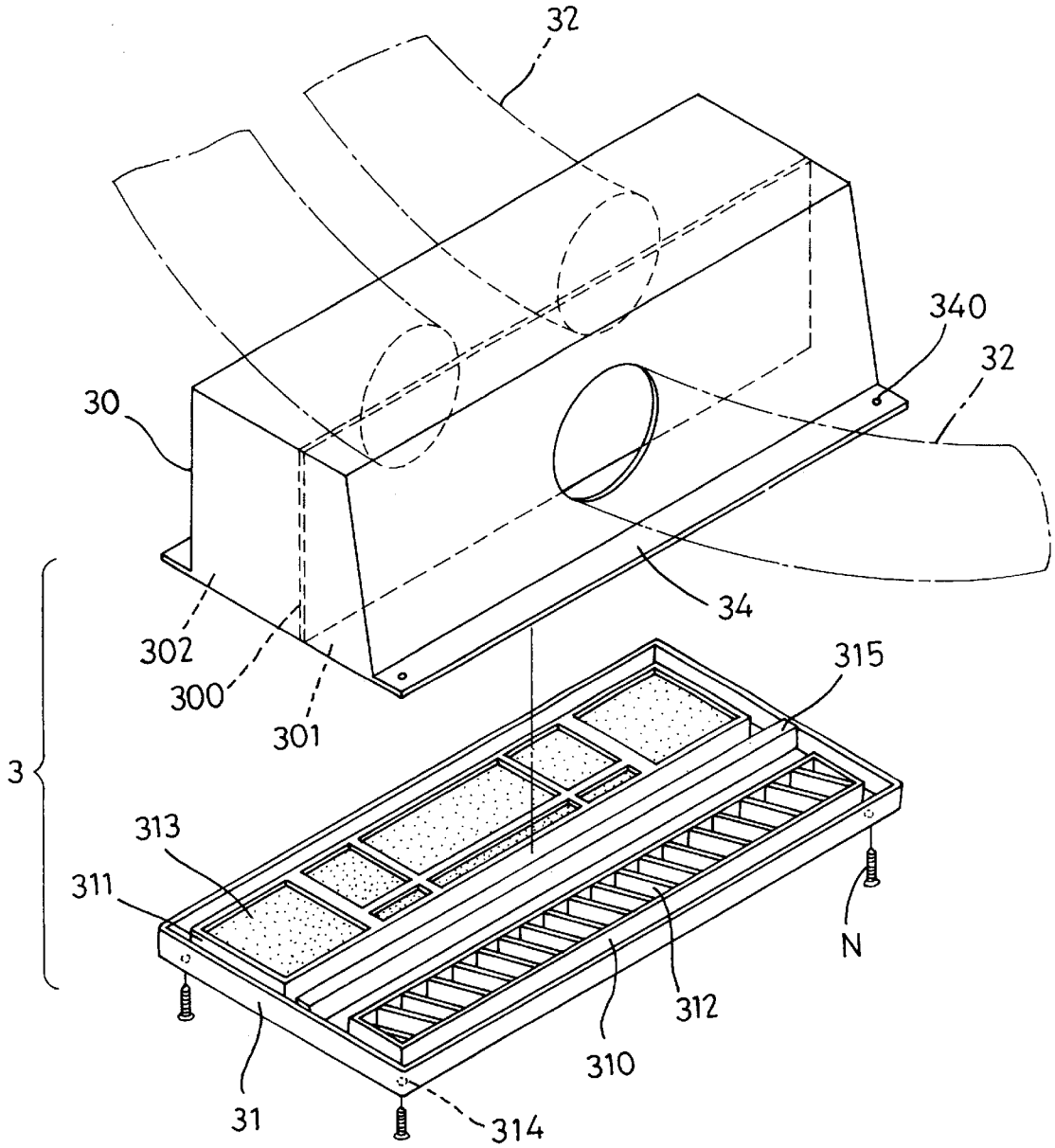
FIG. 3 is an exploded perspective view of a wind inlet and outlet case for a central air conditioning system in the present invention.
Figure 4:
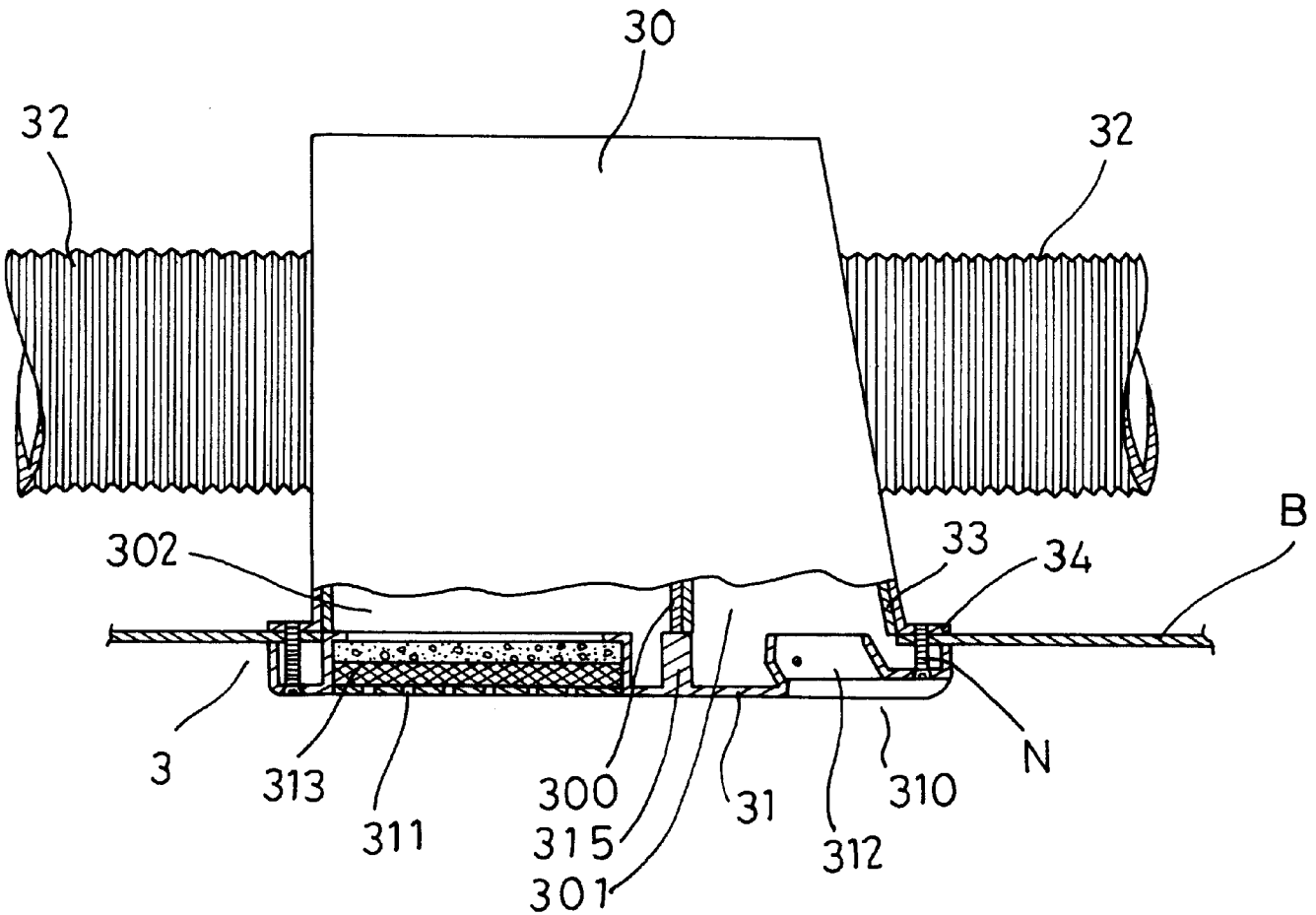
FIG. 4 is a cross-sectional view of the wind inlet and outlet case for a central air conditioning system; and, FIG. 5 is cross-sectional view of the wind inlet and outlet case in the invention, showing the direction of the wind coming in and going out.
Figure 5:
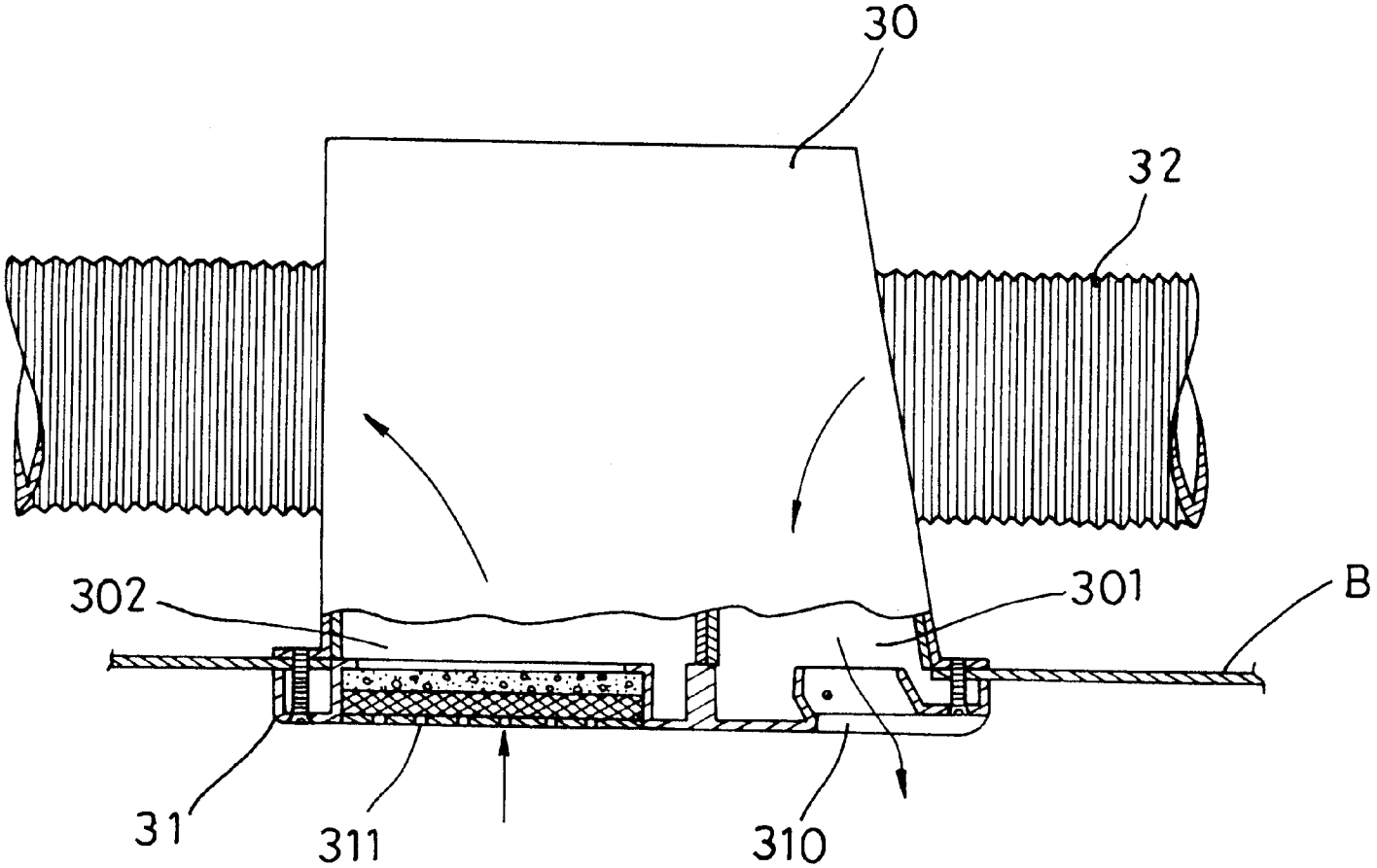

In assembling and using, referring to FIGS. 3, 4 and 5, firstly, the body 30 of the wind inlet and outlet case 3 is fixed with an inner side of the surface B of the ceiling (as shown in FIGS. 3 and 4), and then the face plate 31 is fitted with the bottom of the body 3, with the wind outlet 310 facing the wind outlet room 301 and the wind outlet hole 311 facing the wind inlet room 302, with the lengthwise projecting bar 315 fitting with the separating wall 300, with the leaf unit 313 facing the wind outlet room 301 and adjustable in the direction of blowing wind. The filter 314 of the wind inlet room 311 just faces the entrance of the wind inlet room 302 so that air filtered may circulate to the inner machine via the guide pipe 32 to be treated, as shown in FIG. 5, keeping good quality of circulating air and cool temperature. Finally bolts N screw through the holes 314 of the faceplate 31 and the bolt holes 340 of the connect edge 34 of the body 30, finishing assembling of the invention.

The invention has the following advantages, as seen from the aforesaid description.

1. The faceplate of the wind inlet and outlet case is provided with a wind outlet and wind inlet presenting a beautiful appearance after installed.
2. Plural wind inlet and outlet cases may be connected to the inner machine, easily installed with the ceiling, convenient to maintain and repair with no waste of labor and time, lowering cost and facilitating assembling of components, very practical.
3. The wind outlet room is provided with a layer of temperature preserving material to prevent hot air from percolating in and to keep cool air without forming water drops.
4. The wind inlet and outlet case is provided with a wind outlet and a wind inlet connected separate pipes to properly treating cool and hot air without possibility of mixing together to suck in dirt in an intermediate layer between the ceiling and the floor plate. While the preferred embodiment of the invention has been described above, it will be recognized and understood that various modifications may be made therein and the appended claims are intended to cover all such modifications that may fall in the spirit and scope of the invention.

What is claimed is:

1. A wind inlet and outlet system for an air conditioner, the system comprising:

one or more wind inlet and outlet cases;

an inner machine;

an outer machine that exchanges heat and sends a cooled coolant to the inner machine;

a wind inlet and a wind outlet connected to the case;

the wind inlet and outlet connected to the inner machine such that air from the wind inlet is cooled by the inner machine and directed to the wind outlet;

the case comprises a body and a face plate that are combined together;

the body having a wind outlet room and a wind inlet room separated by a lengthwise wall;

a first guide pipe connected between the inner machine and an outer wall of the wind inlet room;

a second guide pipe connected between the inner machine and the wind outlet room;

the face plate combined with the body, the case having the wind outlet and the wind inlet respectively facing the wind outlet room and the wind inlet room;

the guide pipes are connected to the body substantially parallel to the face plate;

a plurality of the cases are connected to the inner machine;

wherein a horizontal lengthwise bar is provided between the wind inlet room and the wind outlet room and adapted to connect with the lengthwise wall of the body.

2. The wind outlet and inlet system for an air conditioner as claimed in claim 1, wherein the wind outlet room is provided with a layer of insulation material on inner walls thereof so as to preserve cool temperature of air and reduce formation of condensation.

3. The wind inlet and outlet system for an air conditioner as claimed in claim 1, wherein the face plate has a movable leaf unit fitted in the wind outlet and a filter fixed with the wind inlet.

4. The wind inlet and outlet system for an air conditioner as claimed in claim 1, further comprising a filter unit at respective ones of the face plates that filters air entering respective ones of the wind inlet rooms of the cases.

* * * * *